United States Patent [19]

Niles et al.

[11] Patent Number: 4,974,740

[45] Date of Patent: Dec. 4, 1990

[54] TRIPLE-ACTION LATCH FOR A SHIPPING CASE

[75] Inventors: Gerald J. Niles; Davis W. Chamberlin, both of St. Paul; Jacqueline J. Forbes, Woodbury, all of Minn.

[73] Assignee: Minnesota Mining and Manufacturing Company, St. Paul, Minn.

[21] Appl. No.: 488,255

[22] Filed: Mar. 5, 1990

[51] Int. Cl.[5] ..... B65D 43/14

[52] U.S. Cl. ..... 220/324; 206/387

[58] Field of Search ..... 220/341, 337, 387, 306, 220/469, DIG. 26, 338, 349, 345, 342, 343, 324; 206/389

[56] References Cited

U.S. PATENT DOCUMENTS 4,153,178 5/1979 Weavers .

4,211,337 7/1980 Weavers et al. .

*Primary Examiner*—Joseph Man-Fu Moy

*Attorney, Agent, or Firm*—Kinney & Lange

[57] ABSTRACT

A triple-action latch assembly for a shipping case having first and second housing members includes a U-shaped flexible slide movably received on a T-shaped rail associated with the first housing member. The T-shaped rail includes a notch configured to receive a tab associated with the second housing member. When the slide is moved from an open state to a locked state, the tab is trapped within the notch. The slide includes a first detent engageable with an end portion of the rail to secure the slide against movement. The slide further includes a second detent defined by a latch bar having a latch beam engageable with a first cavity in the rail to further secure the slide against movement relative to the T-shaped rail. When the first detent is lifted out of engagement with the rail and the second detent is simultaneously depressed to lift the latch beam out of engagement with the first cavity, the latch assembly can be slid to the open state. In this position, the latch beam engages a second cavity located within the rail and the first detent engages a third cavity also located in the T-shaped rail. The second and third cavities include sloped and inclined surfaces, respectively, that act to automatically cam the latch beam and first detent out of the second and third cavities, respectively, to permit the slide to be merely moved from the open state to the locked state.

25 Claims, 2 Drawing Sheets

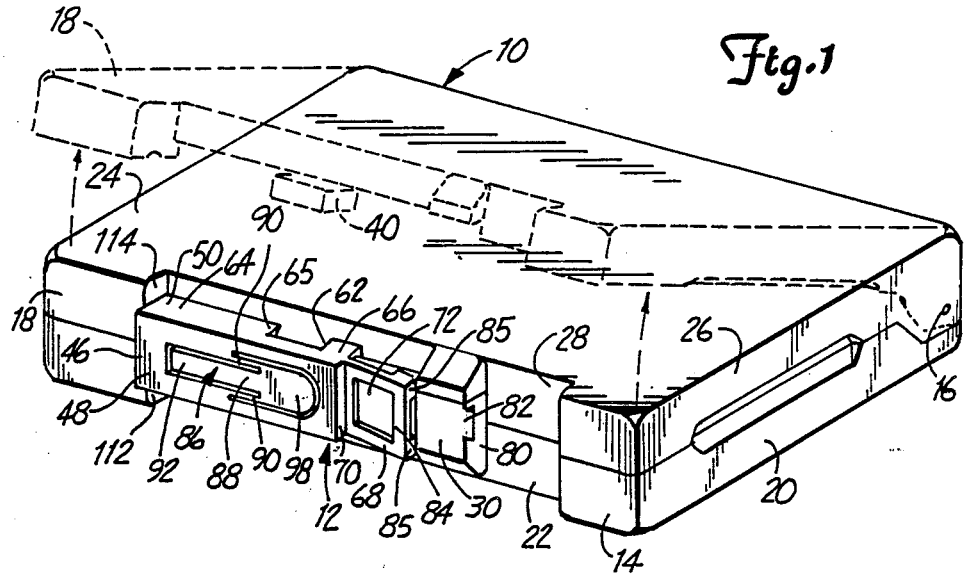
Fig. 1
Fig. 2
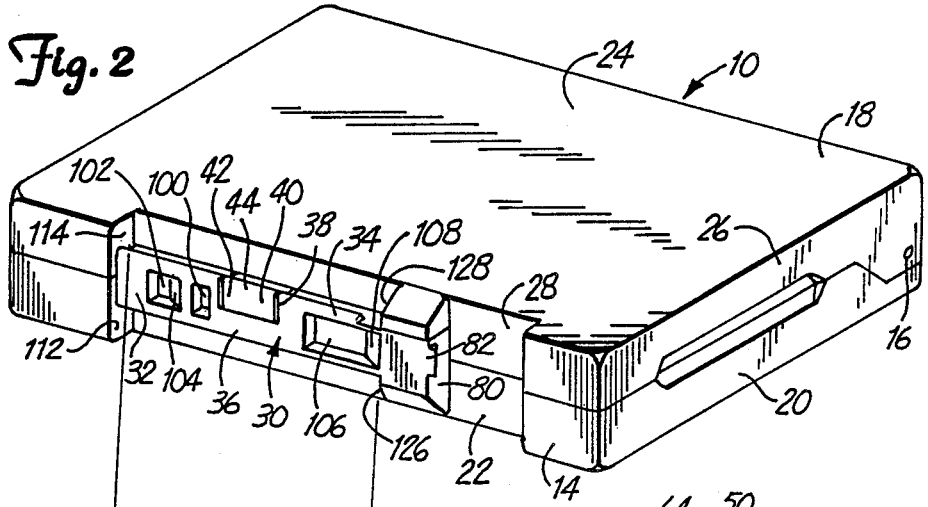
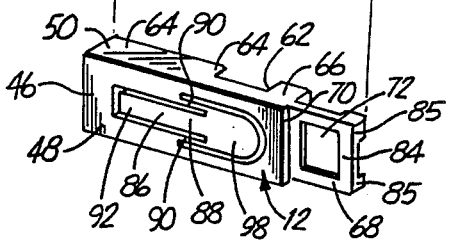
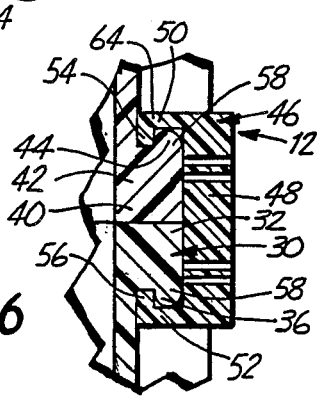
Fig. 6

TRIPLE-ACTION LATCH FOR A SHIPPING CASE

BACKGROUND OF THE INVENTION

This invention relates generally to containers. In particular, the present invention is directed to a triple-action latch for securing together the housing members of a magnetic tape cassette shipping case.

Latch assemblies for containers are in wide spread use. A typical latch for a blow-molded plastic box is disclosed in the Weavers U.S. Pat. No. 4,153,178. The plastic box includes a cover part hinged to a container part. The latch assembly includes a flexible slide that fits around the shoulders of a T-shaped rail which is integral with a side wall of the cover part. The slide is movable along the T-shaped rail between open and locked positions. One shoulder of the rail and a portion of the slide are formed with notches which are aligned when the slide is in the open position. A tab integral with a side wall of the container part fits into the notch in the T-shaped rail when the plastic box is closed and the slide is at the open position. The tab is retained within the notch by a side edge of the slide upon movement of the slide towards the locked position and thereby acts to latch the cover part and container part together. A detent integral with the slide is configured for snap-fitting engagement with an end portion of the T-shaped rail when the slide is at its locked position to provide a second latching action.

However, this double latching action is not always effective to latch the cover part and container part of such a plastic box together. In actual use, the detent has sometimes been accidentally dislodged from its snap fit engagement with the end portion of the T-shaped rail and further jarring has allowed the slide to move to the open position, thus unlocking the plastic box so that its contents could spill out. Moreover, the plastic box when produced must be shipped to production plants with the slide in its locked position (so that the detent is at rest) to allow the plastic detent to cold flow or take a set during shipment. This procedure required production plants to unlock the box (by disengaging the detent from the T-shaped rail and then moving the slide to the open position) before a magnetic tape cassette could be inserted into the box for shipment to customers.

It is evident that there is a continuing need for improved latch assemblies for containers. Specifically, there is a need for a latch assembly that includes a movable slide having a pair of detents that lock the slide against movement to better insure that the slide is not accidentally jarred to its open position, thereby unlocking the container and spilling its contents. In addition, there is needed a latch assembly with a plastic slide that can be left in the open position to allow its plastic detents to cold flow or take set during shipment to production plants. This procedure saves time and money at production plants since the container no longer must be unlocked to permit goods to be inserted into the container for shipment.

SUMMARY OF THE INVENTION

The present invention is a triple action latch for a magnetic tape cassette shipping case. The case includes a first housing member having a T-shaped rail extending along and integral with a side wall of the first housing member. The T-shaped rail is defined by a trunk having first and second oppositely directed shoulders. A notch is formed in a portion of the first shoulder and part of the trunk. A second housing member is pivotally connected to the first housing member. The second housing member includes a tab integral with and extending outwardly from a side wall of the second housing member. The tab is configured to engage the notch of the first housing member when the case is closed.

The triple-action latch is defined by a flexible U-shaped slide having a base portion and first and second outwardly extending legs. The first and second legs include flanges that are configured to fit around the first and second oppositely directed shoulders, respectively, of the T-shaped rail to permit the slide to be moved along the rail between an open state and a locked state. The first leg of the slide includes an opening which is a alignable with the notch of the first housing member in the open state of the slide to allow the tab to be received within the notch. When the slide is moved from the open state toward the locked state, the first leg of the slide traps the tab within the notch to define a first latch action and thereby secure the case in a closed position.

The U-shaped slide includes a first detent that is configured to releasably engage an end portion of the T-shaped rail in the locked state of the slide to define a second latch action and secure the slide against movement relative to the rail. The U-shaped rail further includes a second detent configured to releasably engage a first cavity in the trunk of the T-shaped rail when the slide is in the locked state to define a third latch action and further secure the slide against movement.

The first detent is integrally formed on a first end of the base portion of the U-shaped slide. The first detent is formed so as to have a thickness less than that of the base portion of the slide to enhance the flexibility of the first detent. The first detent is further formed with an opening extending therethrough to further enhance its flexibility. A bottom surface of the first detent includes an outwardly extending latch ridge and the end portion of the T-shaped rail is under cut to form a lip. The latch ridge of the first detent is configured to releasably snap-fit over the lip of the T-shaped rail in the locked state of the slide to define the second latch action. The first detent further includes a lift portion adjacent the latch ridge that allows the first detent to be lifted by one's finger to flex the first detent and disengage the latch ridge from the lip of the T-shaped rail and allow the slide to be moved from the locked state toward the open state. A pair of spaced protrusions located on exposed corners of the first detent help prevent the lift portion from being accidentally raised causing disengagement of the latch ridge from the lip of the T-shaped rail.

The second detent of the U-shaped slide is defined by a latch bar integrally formed with the base portion of the slide. The latch bar is pivotable relative to the base portion of the slide by a pair of living hinge elements that are integrally formed with the latch bar and base portion. A latch beam extends outwardly from a bottom surface of the latch bar at a first end thereof. The latch beam is configured to releasably engage the first cavity of the T-shaped rail in the locked state of the slide to define the third latch action. The latch bar further includes a rounded second end that can be depressed by one's finger to pivot the latch bar and lift the latch beam out of engagement with the first cavity and allow the slide to be moved from the locked state toward the open state. The living hinge elements are molded so as to extend parallel to the longitudinal extent of the base portion of the slide and also parallel to the longitudinal extent of the latch bar itself. This allows the hinge elements to merely flex when the rounded portion of the second detent is depressed to pivot the latch bar to lift the latch beam out of the first cavity.

The trunk of the T-shaped rail further includes a second cavity adjacent the first cavity that is configured to receive the lock beam of the latch bar in the open state of the slide. The second cavity includes a sloped surface that acts to automatically cam the lock beam of the second detent out of the second cavity when the slide is moved from the open state toward the locked state. The trunk of T-shaped rail further includes a third cavity larger than the first or second cavities. The third cavity is located adjacent the end portion of T-shaped rail and is configured to receive the first detent in the open state of the slide. The third cavity includes an inclined surface that acts automatically cam the first detent out of the third cavity when the slide is moved from the open state toward the locked state. The sloped surface of the second cavity, and the inclined surface of the third cavity permit the slide to be merely slid from the open state to the locked state since the first detent and the latch bar are automatically actuated by the sloped and inclined surfaces, respectively.

With the U-shaped slide positioned in the open state, the tab of the second housing member is readily received through the opening in the first leg of the slide and can engage the notch formed in the T-shaped rail of the first housing member. From this position, the slide is merely moved along the T-shaped rail to the locked state. During movement of the slide, the latch beam of the latch bar is automatically cammed out of the second cavity by the sloped surface, and at the same time, the latch ridge of the first detent is automatically cammed out of the third cavity by the inclined surface. As the slide is moved, the first leg of the slide traps the tab within the notch preventing the case from being opened. When the slide reaches the locked state, the latch beam of the latch bar automatically falls into the first cavity and locks the slide against movement relative to the T-shaped rail. In addition, the latch ridge of the first detent is positioned adjacent the lip of the T-shaped rail. The lift portion of the first detent need only be depressed by one's finger to engage the latch ridge with the lip and further secure the slide against movement to securely locking the case in the closed position.

To open the case, the lift portion of the first detent is raised to disengage the latch ridge from the lip, and the rounded second end of the latch bar is simultaneously depressed to disengage the latch beam from the first cavity. With the latch bar and the first detent held in these positions, the U-shaped slide is slid to the open state to realign the opening in the first leg of the slide with the notch of the first housing member. With the slide in the open state, the first and second housing members can be pivoted relative to one another to remove the tab from the notch and open the case.

The use of this triple-action latch with first and second detents insures that the slide is locked against movement and prevents the slide from being accidentally jarred to the open state causing the contents of the case to be spilled. Moreover, since the latch ridge of the first detent rests within the third cavity of the rail, and the latch beam of the second detent rests within the second cavity of the rail in the open state of the slide, the case can be shipped to production plants with the slide in the open state. This allows the first and second plastic detents to cold flow or take set during shipment. This makes for a more efficient design and a better latch assembly. In addition, this allows the case to be simply opened to insert a magnetic tape cassette therein instead of being first unlocked before opening the case, thereby saving magnetic tape cassette production plants time and money in reduced man hours for readying cassettes for shipment to customers.

BRIEF DESCRIPTION OF THE DRAWINGS

FIG. 1 is a perspective view of the case in the closed position with the triple-action latch assembly of the present invention in the open state with the second housing member shown in an open position in phantom lines.

FIG. 2 is a perspective view similar to FIG. 1 with the case in a closed position and the U-shaped slide removed therefrom.

FIG. 6 is a sectional view taken along line 6—6 of FIG. 3 showing the particulars of the T-shaped rail and U-shaped slide.

DETAILED DESCRIPTION OF THE PREFERRED EMBODIMENTS

Figure 3:
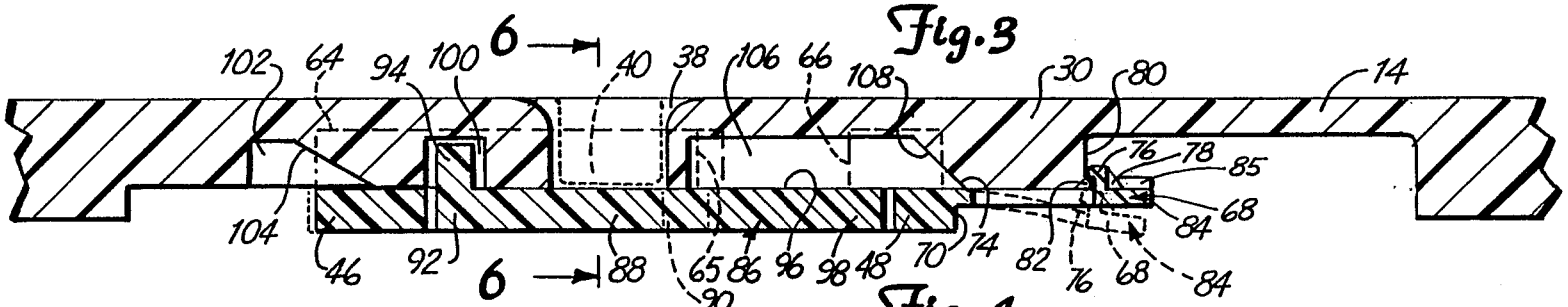
FIG. 3 is a side elevational, sectional view of the U-shaped slide shown in a locked state.

A case or container 10 which includes a triple-action latch assembly 12 in accordance with the present invention is illustrated generally in FIGS. 1 and 2. Case 10 includes a first housing member 14 pivotally attached by pivot mount 16 to a second housing member 18.

First housing member 14 includes a base wall (not shown), a pair of end walls 20 (only one of which is shown in FIGS. 1 and 2), a rear side wall (not shown) and a front side wall 22. The second housing member 18 includes a top wall 24, a pair of end walls 26 (only one of which is shown in FIGS. 1 and 2), a rear side wall (not shown) and a front side wall 28. Case 10 when in a closed position is adapted to hold a magnetic tape cassette (not shown) for shipping.

As seen in FIG. 2, front side wall 22 of the first housing member 14 includes a T-shaped rail 30 defined by a trunk 32 and first and second oppositely directed shoulders 34 and 36, respectively. A notch 38 is formed in a portion of the first shoulder 34 and part of the trunk 32. The notch 38 of the T-shaped rail 30 is configured to receive an integral, outwardly extending tab 40 formed on the front side wall 28 of the second housing member 18 when the case 10 is in a closed position. Tab 40 includes a trunk portion 42 and a third shoulder 44 that are contiguous with the trunk 32 and the first shoulder 34, respectively, of the T-shaped rail 30 in the closed position of the case 10.

Figure 5:
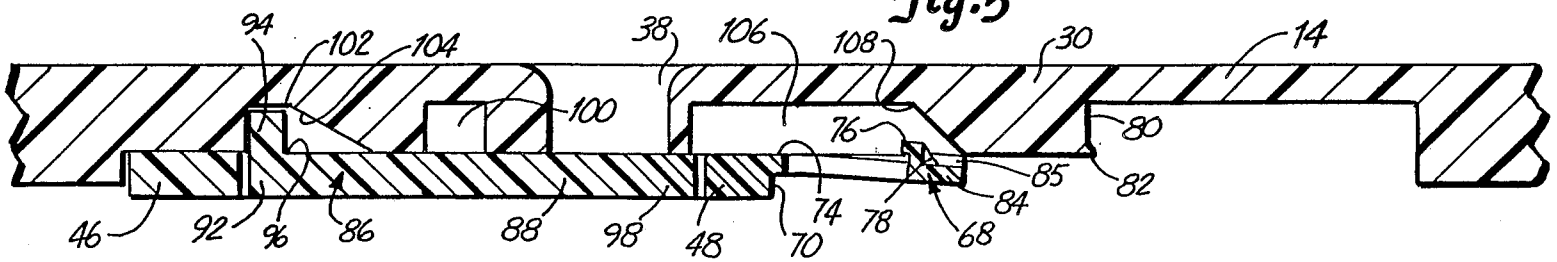
FIG. 5 is a view similar to FIG. 3 but with the U-shaped slide shown in the open state.

As seen in FIGS. 1, 2 and 6, the triple-action latch assembly 12 is slidably mounted on the T-shaped rail 30 of the first housing member 14. The triple-action latch assembly 12 includes a U-shaped flexible slide 46 defined by a base portion 48 and first and second outwardly extending legs 50 and 52. The first and second legs 50 and 52 include first and second perpendicular flanges 54 and 56, respectively (see FIG. 6). The first and second flanges 54 and 56 extend toward one another and are configured to fit around the first and second oppositely directed shoulders 34 and 36, respectively, of the T-shaped rail 30 to permit the U-shaped slide 46 to be moved along the rail 30 between an open state as shown in FIGS. 1 and 5 and a locked state as shown in FIG. 3. The first and second shoulders 34 and 36 are rounded at the their outer edges 58 (see FIG. 6) to permit the flexible U-shaped slide 46 to be readily installed on the rail 30 by flexing the first and second legs 50 and 52 outwardly.

As seen in FIG. 1, the first leg 50 of the slide 46 includes an opening 62 which is aligned with the notch 38 in the open state of the U-shaped slide 46. In the open state of the slide 46, the tab 40 of the second housing member 18 is freely engageable with the notch 38 so that the case 10 is in a closed position (solid lines in FIG. 1) or in an open position (phantom lines in FIG. 1). The opening 62 in the first leg 50 divides the first leg 50 into a long leg portion 64 and a short leg portion 66. When the U-shaped slide 46 is slid along the rail 30 from the open state toward the locked state, the long leg portion 64 engages the third shoulder 44 of the tab 40 and thereby traps the tab 40 within the notch 38 (see FIG. 6) to define a first latch action and secure the case 10 in the closed position. The long leg portion 64 of the first leg 50 includes a ramped guide surface 65 (see FIGS. 1 and 2) adjacent the opening 62 that acts to urge the tab 40 into the notch 38 when the slide 46 is moved from the open state toward the locked state.

Figure 4:
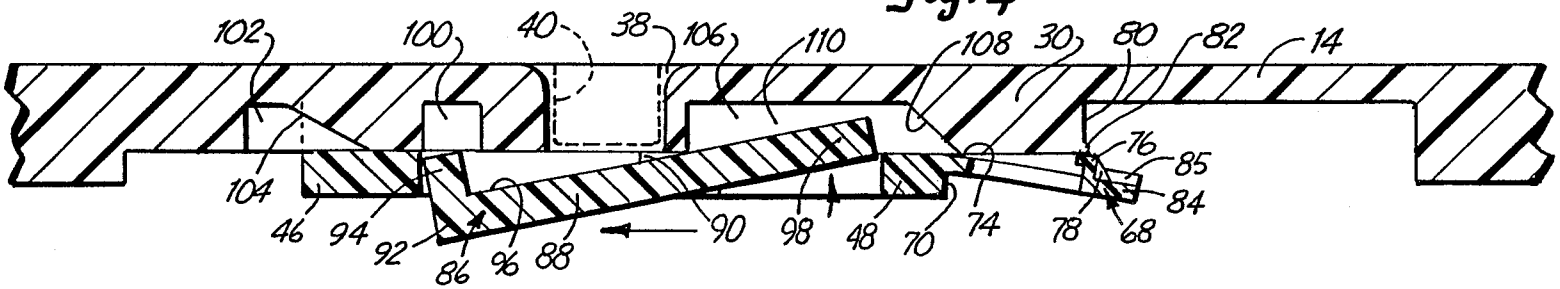
FIG. 4 is a view similar to FIG. 3 with the first and second detents of the U-shaped slide shown disengaged from the lip and the first cavity, respectively.

As seen in FIGS. 1 and 2, the U-shaped, flexible slide 46 further includes a first detent 68 integrally formed on a first end 70 of the base portion 48. The first detent 68 is formed to have a thickness less than the thickness of the base portion 48 of the slide 46 to enhance the flexibility of the first detent 68. In addition, first detent 68 has a reduced effective width (achieved, for example, by providing an opening 72 extending therethrough) that further enhances flexibility. As seen in FIGS. 3–5, a bottom surface 74 of the first detent 68 includes an integral, L-shaped latch ridge 76. A rigidifying brace 78 extends between the latch ridge 76 and the bottom surface 74 of the first detent 68 and acts to strengthen the latch ridge 76. An end portion 80 of the T-shaped rail 30 is undercut to form a lip 82. As seen in solid lines in FIG. 3, the latch ridge 76 is engageable with the lip 82 when the slide is in the locked state to define a second latch action and secure the slide 46 against movement relative to the rail 30. The first detent 68 further includes a lift portion 84 adjacent the L-shaped latch ridge 76. As seen in phantom lines in FIG. 3, the lift portion 84 is configured to be engaged by one's finger to flex the first detent 68 and thereby disengage the latch ridge 76 from the lip 82. The first detent 68 further includes a pair of spaced protrusions 85 extending outwardly from the bottom surface 74. The protrusions 85 help prevent the lift portion 84 from being accidentally raised causing disengagement of the latch ridge 76 from the lip 82.

As seen in FIGS. 1 and 2, the base portion 48 of the U-shaped slide 46 further includes a second detent 86 defined by a latch bar 88 integrally formed with the base portion 48. A pair of living hinge elements 90 are integrally formed with the latch bar 88 and the base portion 48 to allow the latch bar 88 to pivot relative to the base portion 48 of the slide 46. As seen in FIGS. 3–5, a first end 92 of the latch bar 88 includes an outwardly extending latch beam 94 formed integrally with a bottom surface 96 of the latch bar 88. The latch bar 88 further includes a rounded second end 98 (see FIGS. 1 and 2) that is configured to be depressed by one's finger to pivot the latch bar 88 relative to the base portion 48 (see FIG. 4). The living hinge elements 90 extend parallel to the longitudinal extent of the base portion 48 and the longitudinal extent of latch bar 88 such that the hinge elements 90 are merely flexed when the latch bar 88 is pivoted. As seen in FIGS. 2 and 3, the trunk 32 of the T-shaped rail 30 includes a first cavity 100 that is configured to receive the latch beam 94 of the latch bar 88 when the slide 46 is in the locked state. To disengage the latch beam 94 from the first cavity 100, the rounded second end 98 of a latch bar 88 is depressed to lift the latch beam 94 out of engagement with the first cavity 100 (see FIG. 4).

As seen in FIGS. 2 and 5, the trunk 32 of the T-shaped rail 30 further includes a second cavity 102 adjacent the first cavity 100 that is configured to receive the latch beam 94 when the slide 46 is in the open state. The second cavity 102 includes a sloped surface 104 directed along the length of the T-shaped rail 30. The sloped surface 104 acts to automatically cam the latch beam 94 of the latch bar 88 out of the second cavity 102 when the slide 46 is moved from the open state toward the locked state.

As seen in FIGS. 2 and 5, the trunk 32 of the T-shaped rail 30 further includes a third cavity 106 adjacent the end portion 80 of the T-shaped rail 30. The third cavity 106 is larger than the first and second cavities 100 and 102. The third cavity 106 further includes an inclined surface 108 directed along the longitudinal extent of the T-shaped rail 30. The inclined surface 108 acts to automatically cam the latch ridge 76 of the first detent 68 out of the third cavity 106 when the slide 46 is moved from the open state toward the locked state. As seen in FIG. 4, the third cavity 106 also provides a clearance space 110 for the rounded second end 98 of the latch bar 88 when it is depressed to lift the latch beam 94 out of engagement with the first cavity 100.

In the embodiment of the latch bar 88 described above, the rounded second end 98 is in the same plane as the first end 92. In an alternative configuration (not shown), the latch bar 88 can be V-shaped (when viewed from the perspective shown in FIGS. 3–5) with the rounded second end 98 angled outwardly from the first end 92. In this configuration, the rounded second end 98 extends above a top surface of the base portion 48 of the slide 46 when the latch beam 94 is disposed within the first cavity 100. When the rounded second end 98 is depressed to lift the latch beam 94 out of engagement with the first cavity 100, the rounded second end 98 does not extend into the clearance space 110 of the cavity 106 as far as in the illustrated embodiment. Thus, the third cavity 106 need not be as deep. In addition, the top surface of the base portion 48 adjacent the rounded second end 98 is raised to prevent the rounded second end 98 from being depressed inadvertently. By using this configuration the latch assembly 12 and the first and second housing members 14 and 18 are easier and less expensive to manufacture.

As seen in FIGS. 1 and 2, the first and second housing members 14 and 18 further include rectangular stop end walls 112 and 114, respectively, that limit the extent the slide 46 can be moved from the locked state to the open state. The first and second housing members 14 and 18 further include triangular stop end walls 126 and 128, respectively. The triangular stop end walls 126 and 128 are engaged by the second leg 52 and the short leg portion 66, respectively, to limit the extent the slide 46 can be moved from the open state toward the locked state.

In operation, with the U-shaped slide 46 initially in the open state, the opening 62 in the first leg 50 is aligned with the notch 38 in the T-shaped rail 30. In this open state (FIG. 5), the tab 40 of the second housing member 18 can be readily passed through the opening 62 and engage the notch 38 to close the case 10. In this position, the latch ridge 76 of the first detent 68 is positioned within the third cavity 106 of the T-shaped rail 30. In addition, the latch beam 94 of the latch bar 88 is received within the second cavity 102 of the T-shaped rail 30. To lock case 10, the slide 46 is merely slid from the open state toward the closed state. During this movement, the sloped surface 104 and the inclined surface 108 automatically act to cam the latch beam 94 and latch ridge 76 out of the second and third cavities 102 and 106, respectively.

During this movement, the ramped guide surface 65 urges the tab 40 of the second housing member 18 into the notch 38 of the first housing member 14. When the slide 46 reaches the locked state as shown in FIG. 3, the latch beam 94 of the latch bar 88 automatically drops into the first cavity 100 to secure the slide 46 against movement. In addition the latch ridge 76 of the first detent 68 is located on the upper edge of the lip 82. In this position, the lift portion 84 of the first detent 68 need only be depressed to snap-fit the latch ridge 76 over the lip 82 and further secure the slide 46 against movement relative to the rail 30.

To open the case 10, the lift portion 84 is raised to disengage the latch ridge 76 from the lip 82. Simultaneously therewith, the rounded second end 98 of the latch bar 88 is depressed to lift the latch beam 94 out of the first cavity 100. With the first detent 68 and latch bar 88 held in these positions the slide 46 is moved from the locked state to the open state. In the open state (FIG. 5), the latch beam 94 again engages the second cavity 102 and the latch ridge 76 again engages the third cavity 106. The opening 62 is again aligned with the notch 38, the first and second housing members 14 and 18 can be pivoted relative to one another to remove the tab 40 from the notch 38 and the container 10 opened.

The triple-action latch assembly 12 with first and second detents 68 and 86 insures that the slide 46 is locked against movement to prevent it from being accidentally jarred to the open state causing the contents of the case 10 to be possibly spilled. Moreover, since the latch ridge 76 rests within the third cavity 106, and the latch beam 94 rests within the second cavity 102 in the open state of the slide 46, the case 10 can be shipped to production plants with the slide 46 in the open state. This allows the first and second plastic detents 68 and 86 to cold flow or take set during shipment. This makes for a more efficient design and a better latch assembly. In addition, this allows the case 10 to be simply opened to insert a magnetic tape cassette therein instead of being first unlocked before opening the case 10. This in turn results in a more efficient magnetic tape cassette production process, since less time and money (in reduced man hours) are necessary for readying cassettes for shipment to customers.

In the preferred embodiment of the present invention the first and second housing members 14 and 18, and the latch assembly 12 are made of plastic such as polyethylene. The latch assembly 12 is formed by injection molding, whereas the first and second housing members 14 and 18 are formed via blow-molding. After these components are formed and while they are still warm from the heat of molding, the housing members 14 and 18 are assembled to form the case 10 and the latch assembly 12 is installed on the T-shaped rail 30 of the first housing member 14. Since the slide 46 of the latch assembly 12 is still warm and has not fully cured, the first and second legs 50 and 52 easily flex to permit the first and second flanges 54 and 56 to pass over and then fit around the first and second shoulders 34 and 36, respectively, of the rail 30. Once installed, the latch assembly 12 is initially aligned so that the slide 46 is in the open state with the latch ridge 76 of the first detent 68 resting within the third cavity 106, and the latch beam 94 of the second detent 86 resting within the second cavity 102. This procedure allows the plastic first and second detents 68 and 86 to cold flow or take set (i.e. cure) to their final orientation relative to the slide 46 (as seen FIG. 5) during a nonuse period such as during shipment of the case 10 to production plants.

Although the present invention has been described with reference to preferred embodiments, workers skilled in the art will recognize that changes may be made in form and detail without departing from the spirit and scope of the invention.

What is claimed is:

1. A closure assembly, comprising:

a first member including a rail extending along a side wall thereof;

a second member engageable with the first member; and a triple action latch, including:

a slide moveable along the rail between an open state and a locked state, the slide engaging a latch portion of the second member in the locked state of the slide to define a first latch action and thereby secure the first member to the second member;

a first detent mounted on the slide and configured to releasably engage an end portion the rail in the locked state of the slide to define a second latch action and thereby secure the slide against movement relative to the rail; and a second detent mounted on the slide and configured to releasably engage a first cavity in the rail when the slide is in the locked state to define a third latch action and thereby further secure the slide against movement relative to the rail.

2. The closure assembly of claim 1 wherein the rail further includes:

a second cavity adjacent the first cavity that is configured to receive the second detent in the open state of the slide.

3. The closure assembly of claim 2 wherein the second cavity includes a sloped surface that acts to automatically cam the second detent out of the second cavity when the slide is moved from the open state toward the locked state.

4. The closure assembly of claim 1 wherein the rail further includes:

a third cavity adjacent the end portion of the rail that is configured to receive the first detent in the open state of the slide.

5. The closure assembly of claim 4 wherein the third cavity includes an inclined surface that acts to automatically cam the first detent out of the third cavity when the slide is moved from the open state toward the locked state.

6. The closure assembly of claim 1 wherein the first detent is integrally formed on a first end of the slide, and wherein the first detent is formed to have an area of reduced material as compared to the slide to enhance the flexibility of the first detent.

7. The closure assembly of claim 6 wherein the end portion of the rail is undercut to form a lip, and a bottom surface of the first detent includes a latch ridge extending therefrom that is configured to releasably engage the lip in the locked state of the slide to further define the second latch action, and wherein the latch ridge is received in the third cavity in the open state of the slide.

8. The closure assembly of claim 7 wherein the first detent further includes a lift portion adjacent the latch ridge that is configured to be engaged by one's finger, to flex the first detent and disengage the latch ridge from the lip and permit the slide to be moved from the locked state toward the open state.

9. The closure assembly of claim 8 wherein the first detent includes a pair of spaced protrusions extending outwardly from the bottom surface thereof that help prevent the latch ridge from being accidentally disengaged from the lip of the rail.

10. The closure assembly of claim 1 wherein the second detent includes:

a latch bar, including:

a pair of hinge elements joining the latch bar to a base portion of the slide, the hinge elements allowing the latch bar to pivot relative to the base portion of the slide; and a latch beam extending from a bottom surface of the latch bar at a first end thereof, the latch beam being configured to releasably engage the first cavity in the locked state of the slide to further define the third latch action, and wherein the latch beam is configured to releasably engage the second cavity in the open state of the slide.

11. The closure assembly of claim 10 wherein the latch bar further includes:

a second end that is configured to be depressed by one's finger to pivot the latch bar and lift the latch beam out of the first cavity and allow the slide to be moved from the locked state toward the open state.

12. The closure assembly of claim 10 wherein the latch bar is integrally formed with the base portion of the slide, and wherein the pair of hinge elements are a pair of living hinge elements integrally formed with the latch bar and the base portion of the slide.

13. The closure assembly of claim 12 wherein the pair of living hinge elements extend parallel to a longitudinal extent of the base portion of the slide, and wherein the living hinge elements are flexed when the latch bar is pivoted.

14. The closure assembly of claim 1 wherein the rail is integral with the side wall of the first member, and is T-shaped as defined by a trunk having first and second oppositely directed shoulders, and wherein the slide is U-shaped as defined by a base portion having first and second outwardly extending legs, the legs including perpendicular flanges that are configured to fit around the first and second oppositely directed shoulders of the T-shaped rail and permit the slide be moved along the rail between the open state and the locked state.

15. The closure assembly of claim 14 wherein the T-shaped rail includes a notch formed in a portion of the first shoulder and part of the trunk, and wherein the latch portion of the second member includes a tab integral with and extending from a side wall of the second member, the tab being configured to engage the notch when the first member is engaged with the second member.

16. The closure assembly of claim 15 wherein the first leg of the U-shaped slide includes an opening which is alignable with the notch in the open state of the slide to allow the tab to be received within the notch, the first leg of the slide trapping the tab within the notch in the locked state of the slide to further define the first latch action and thereby secure the first member to the second member.

17. The closure assembly of claim 16 wherein the closure assembly is a container assembly and the first and second members are first and second housing members, and the slide in the locked state secures the container in a closed position.

18. The closure assembly of claim 14 wherein the first detent is integrally formed on a first end of the slide, and wherein the first detent is formed to have a thickness less than the base portion of the slide to enhance the flexibility of the first detent.

19. The closure assembly of claim 18 wherein the first detent further includes an opening extending therethrough to further enhance the flexibility of the first detent.

20. The closure assembly of claim 16 wherein a portion of the first leg of the slide adjacent the opening has a ramped guide surface that acts to urge the tab of the second member into the notch of the first member.

21. The closure assembly of claim 1 wherein the first and second members include stop end walls which limit movement of the slide.

22. The closure assembly of claim 16 wherein the first and second shoulders of the T-shaped rail are rounded to permit the slide to be readily installed on the first member.

23. The closure assembly of claim 15 wherein the tab includes a third shoulder that is contiguous with the first shoulder of the T-shaped rail when the first member is engaged with the second member.

24. A container assembly, comprising:

a first housing member, including:

a rail extending along and integral with a side wall of the first housing member, wherein the rail is T-shaped is defined by a trunk having first and second oppositely directed shoulders, the T-shaped rail including a notch formed in a portion of the first shoulder and part of the trunk;

a second housing member pivotally connected to the first housing member and including:

a tab integral with and extending outwardly from a side wall of the second housing member, the tab configured to engage the notch when the container is in a closed position; and a triple acting latch, including:

a U-shaped, flexible slide having a base portion and first and second outwardly extending legs, the legs including perpendicular flanges that are configured to fit around the first and second oppositely directed shoulders of the T-shaped rail and permit the slide to be moved along the rail between an open state and a locked state, the first leg of the slide having an opening which is alignable with the notch in the open state of the slide to allow the tab to be received within the notch, the first leg of the slide trapping the tab within the notch in the locked state of the slide to define a first latch action and thereby secure the container in the closed position;

a first detent integral with the slide and configured to releasably engage an end portion of the T-shaped rail in the locked state of the slide to define a second latch action and thereby secure the slide against movement relative to the T-shaped rail; and a second detent integral with the slide and configured to releasably engage a first cavity in the trunk of the T-shaped rail when the slide is in the locked state to define a third latch action and thereby further secure the slide against movement relative to the T-shaped rail.

25. A container assembly, comprising:

a first housing member, including:

a rail extending along a side wall of the first housing member, the rail having a cavity located adjacent an end portion of the rail;

a second housing member pivotally connected to the first housing member; and a latch, including:

a slide moveable along the rail between an open state wherein the first and second housing members are freely, pivotally moveable relative to one another, and a locked state wherein the slide engages a latch portion of the second housing member to secure the container in a closed position; and a plastic detent mounted on the slide and configured to releasably engage the end portion of the rail in the locked state of the slide to secure the slide against movement relative to the rail, the detent in the open state of the slide being receivable in the cavity of the rail so that the plastic detent can cold flow while the slide is in the open state.

* * * * *